US007952030B2

(12) United States Patent
Ho et al.

(10) Patent No.: US 7,952,030 B2
(45) Date of Patent: May 31, 2011

(54) WIRE GUIDE FOR ELECTRONIC DEVICE

(75) Inventors: Lien-Hsun Ho, Taipei (TW); Hsiung-Kuei Cheng, Taipei (TW); Chung-Chien Tseng, Taipei (TW)

(73) Assignee: Cyber Power System Inc., Taipei (TW)

( * ) Notice: Subject to any disclaimer, the term of this patent is extended or adjusted under 35 U.S.C. 154(b) by 246 days.

(21) Appl. No.: 12/318,484

(22) Filed: Dec. 30, 2008

(65) Prior Publication Data

US 2010/0163279 A1 Jul. 1, 2010

(51) Int. Cl.
*H01B 7/24* (2006.01)

(52) U.S. Cl. ..... 174/136; 174/92; 174/164; 138/110; 248/49

(58) Field of Classification Search ..... 174/136, 174/72 A, 92, 164; 248/71, 73, 49; 138/110
See application file for complete search history.

(56) References Cited

U.S. PATENT DOCUMENTS 4,045,612 A * 8/1977 Troy ..... 174/136
5,556,059 A * 9/1996 Maeda et al. ..... 248/49
5,962,814 A * 10/1999 Skipworth et al. ..... 174/135
6,380,485 B1 * 4/2002 Beaman et al. ..... 174/88 R
7,021,959 B2 * 4/2006 Tsuji et al. ..... 439/470

* cited by examiner

*Primary Examiner* — Dhiru R Patel
(74) *Attorney, Agent, or Firm* — Posz Law Group, PLC

(57) ABSTRACT

A wire guide for an electronic device has a base being mounted in the electronic device and a protecting tube being pivotally mounted in the base. Wires of the electronic device are mounted through the protecting tube so the wires pivot smoothly to connect the electronic device conveniently to a power supply. Therefore, The wires do not have to be bent or forced so the electronic device is more convenient to use, and safer since the wires and protective tube are not snapped easily.

5 Claims, 6 Drawing Sheets

WIRE GUIDE FOR ELECTRONIC DEVICE

BACKGROUND OF THE INVENTION

1. Field of the Invention

The present invention relates to a wire guide for an electronic device, especially to a wire guide that allows wires of the electronic device to pivot without causing failure to the wires.

2. Description of the Prior Arts

Electronic devices have a lead and a plug. The plug is electrically connected to a distal end of the lead and is put in a socket to transmit electricity to the electronic device through the lead.

With reference to FIG. 6, a conventional electronic device (40), such as an extension cord, has a housing (41), multiple sockets (42) and a lead (43). The housing (41) has an end and a protecting tube (411). The protecting tube (411) is securely mounted on the end of the housing (41) and has a hole communicating with the housing (41). The sockets (42) are separately embedded in the housing (41) for mounting electrical plugs. The lead (43) is mounted through and protrudes from the protecting tube (411) of the housing (41), is electrically connected to the sockets (42) and a power supply to provide power to the sockets (42) and has multiple wires and an insulating cover. The insulating cover is formed around the wires.

The protecting tube (411) prevents the wires of the lead (43) from being levered out of the end of the housing (41) or the insulating cover suffering excessive fatigue. However, as the lead (43) is repeatedly bent and twisted during use, the wires of the lead (43) may be snapped or the protective tube (411) removed from the housing (41), exposing the wires and causing danger of electric shock and fire. Furthermore, extension cords and leads (43) are frequently hidden behind furniture, along walls or in corners, so removal of the protective tube (411) may be promoted by persons moving the furniture, forcing the extension cord into a corner or between furniture so crushing the extension cord or protective tube (411).

To overcome the shortcomings, the present invention provides a wire guide for an electronic device to mitigate or obviate the aforementioned problems.

SUMMARY OF THE INVENTION

The main objective of the present invention is to provide a wire guide for an electronic device. The wire guide has a base being mounted in the electronic device and a protecting tube being pivotally mounted in the base.

Wires of the electronic device are mounted through the protecting tube so the wires pivot smoothly to connect the electronic device conveniently to a power supply. Therefore, The wires do not have to be bent or forced so the electronic device is more convenient to use, and safer since the wires and protective tube are not snapped easily.

Other objectives, advantages and novel features of the invention will become more apparent from the following detailed description when taken in conjunction with the accompanying drawings.

DETAILED DESCRIPTION OF THE PREFERRED EMBODIMENTS

Figure 3:
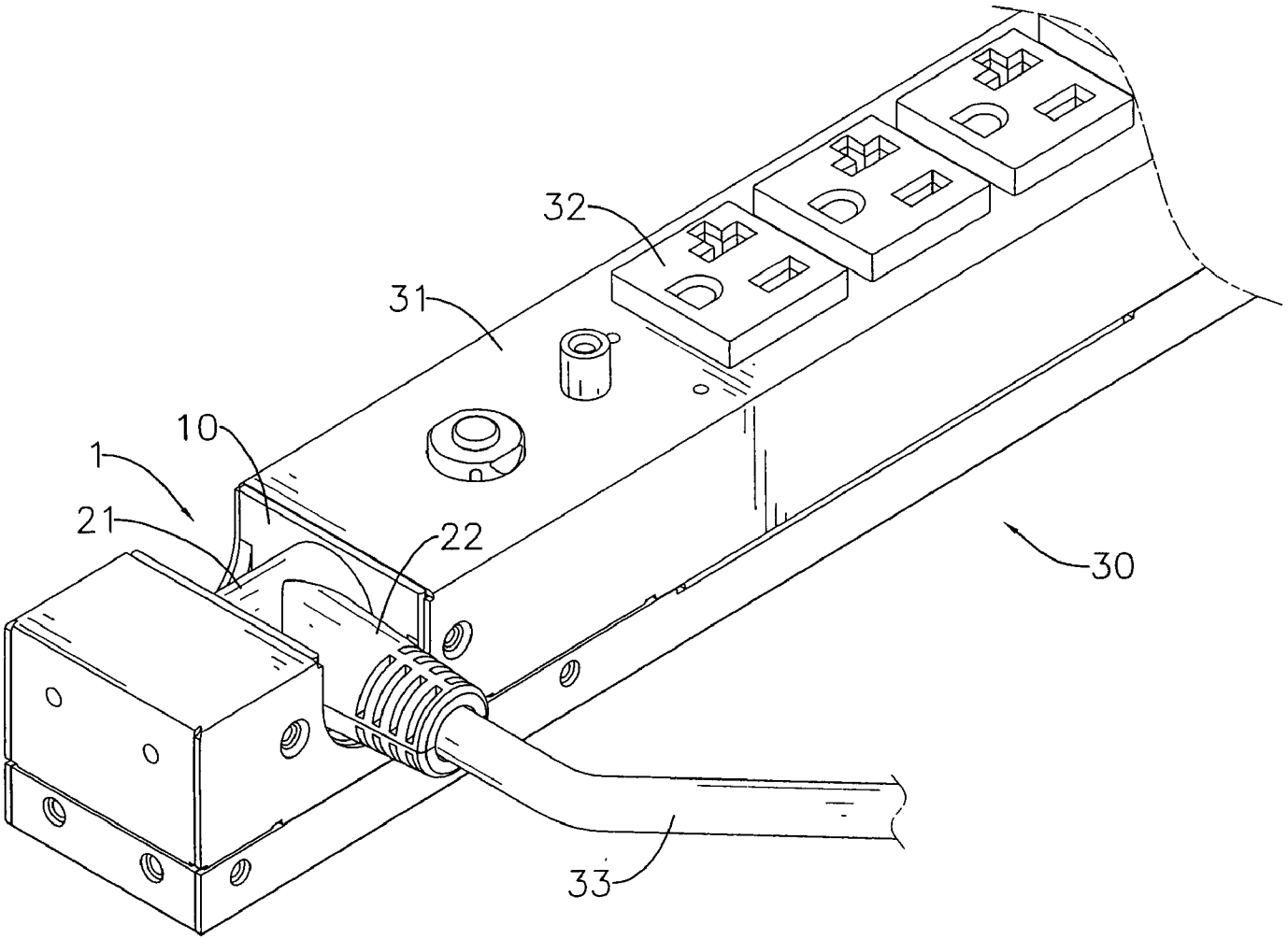
FIG. 3 is a partial perspective view of the wire guide in FIG. 1, showing the protecting tube mounted in an electronic device.
Figure 4:
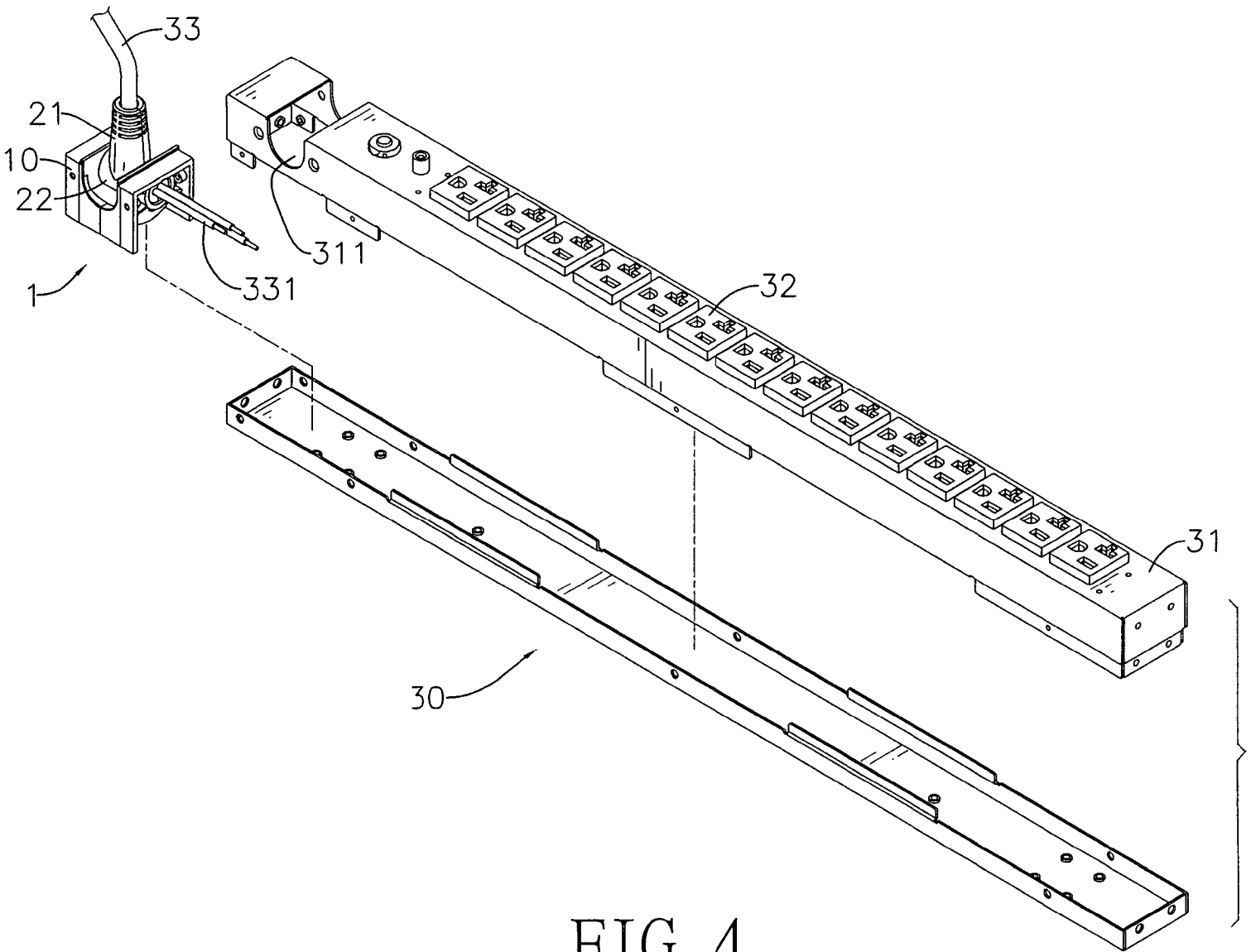
FIG. 4 is an operational exploded perspective view of the wire guide in FIG. 3.

With reference to FIGS. 3 and 4, an electronic device (30), such as an extension cord, comprises a housing (31), multiple sockets (32) and a lead (33). The housing (31) has an upper surface and a mounting recess (311). The mounting recess (311) is formed in the upper surface of the housing (31). The sockets (32) are separately embedded in the upper surface of the housing (31) and may be arranged in a line perpendicular to the mounting recess (311) of the housing (31). The lead (33) is mounted in the housing (31), is electrically connected to the sockets (32) and has a distal end and multiple wires (331). The distal end of the lead (33) is selectively connected electrically to a power supply.

Figure 1:
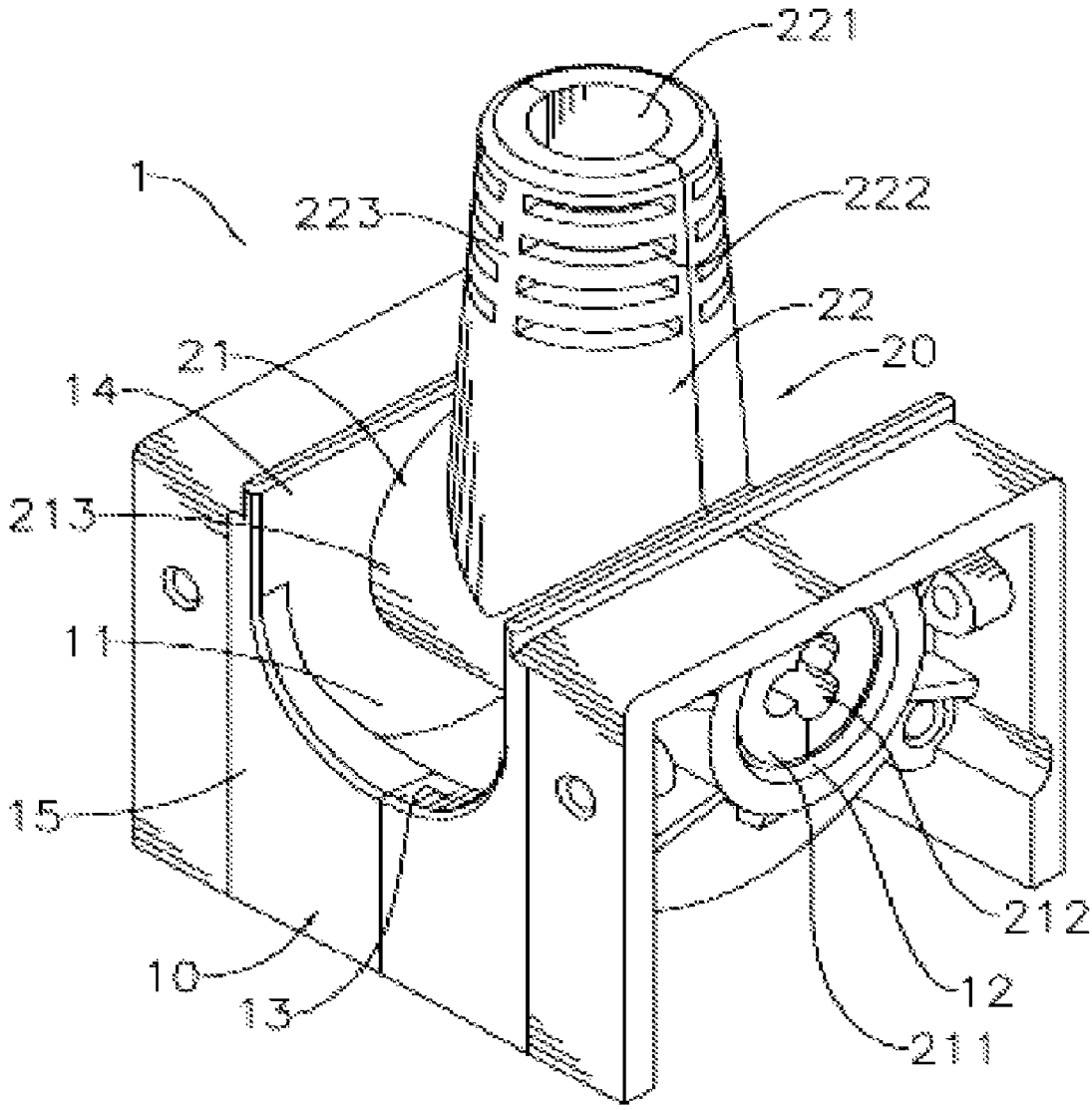
FIG. 1 is a perspective view of a wire guide for an electronic device in accordance with the present invention.

With further reference to FIG. 1, a wire guide (1) for the electronic device (30) in accordance with the present invention is mounted in the mounting recess (311) of the housing (31) of the electronic device (30) and comprises a base (10) and a protecting tube (20).

Figure 2:
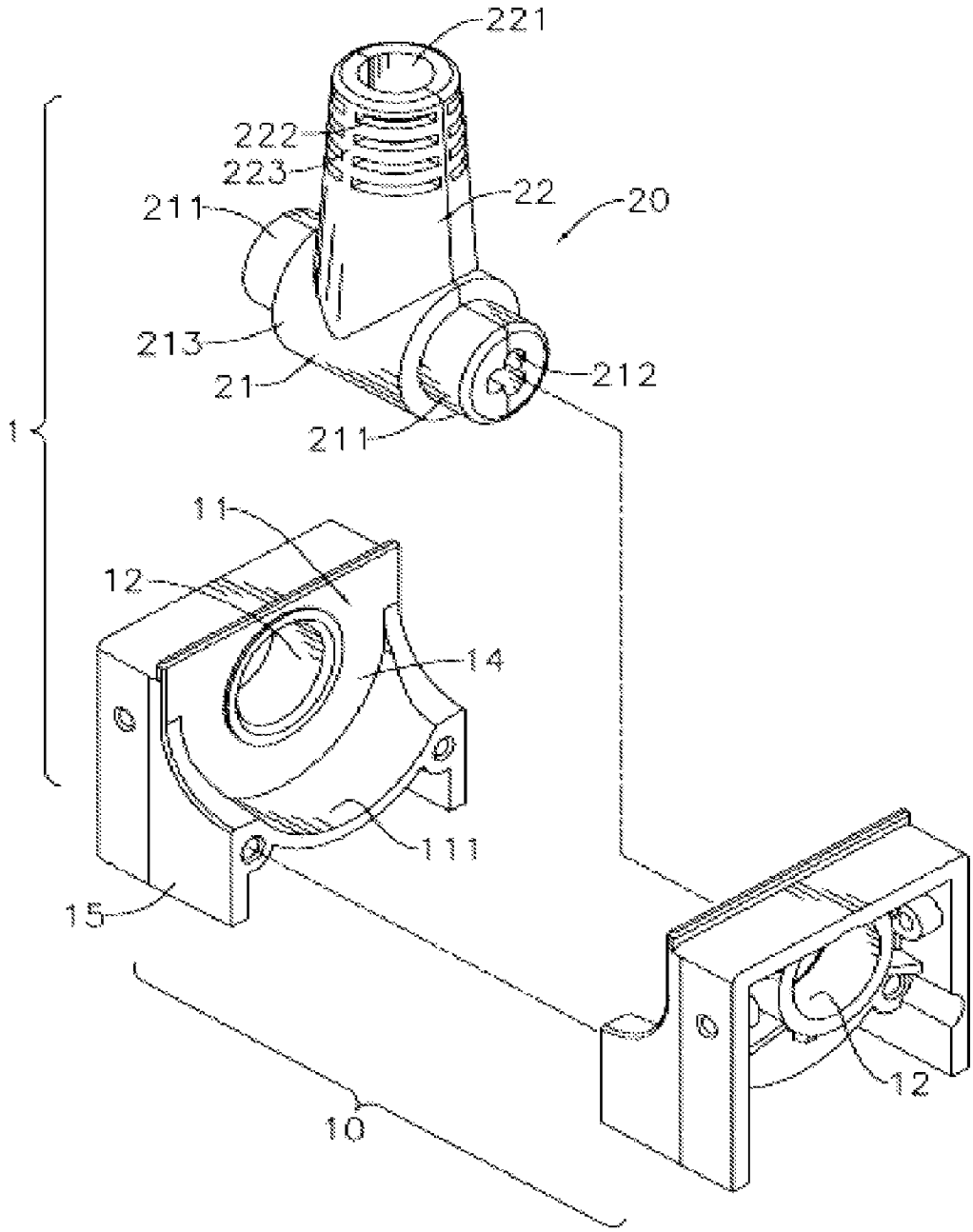
FIG. 2 is an exploded perspective view of the wire guide in FIG. 1.

With further reference to FIG. 2, the base (10) may be formed from two segments, is securely mounted in the mounting recess (311) of the housing (31) of the electronic device (30), has an upper surface, two opposite pivoting walls (14), two opposite limiting walls (15), a tube recess (11), two pivot holes (12) and may have two limiting recesses (13).

The tube recess (11) is formed in the upper surface of the base (10) and may have a bottom (111). The bottom (111) of the tube recess (11) is semi-cylindrical.

The pivot holes (12) are respectively formed through the opposite pivoting walls (14) of the base (10). Each pivot hole (12) may align with the other pivot hole (12) of the base (10).

The limiting recesses (13) are respectively formed in the limiting walls (15) of the base (10) and communicate with the tube recess (11).

The protecting tube (20) may be formed from two segments, may be resilient, is disposed in the tube recess (11) of the base (10), is mounted rotatably on the base, and has a shaft (21) and a cable mount (22).

Figure 5:
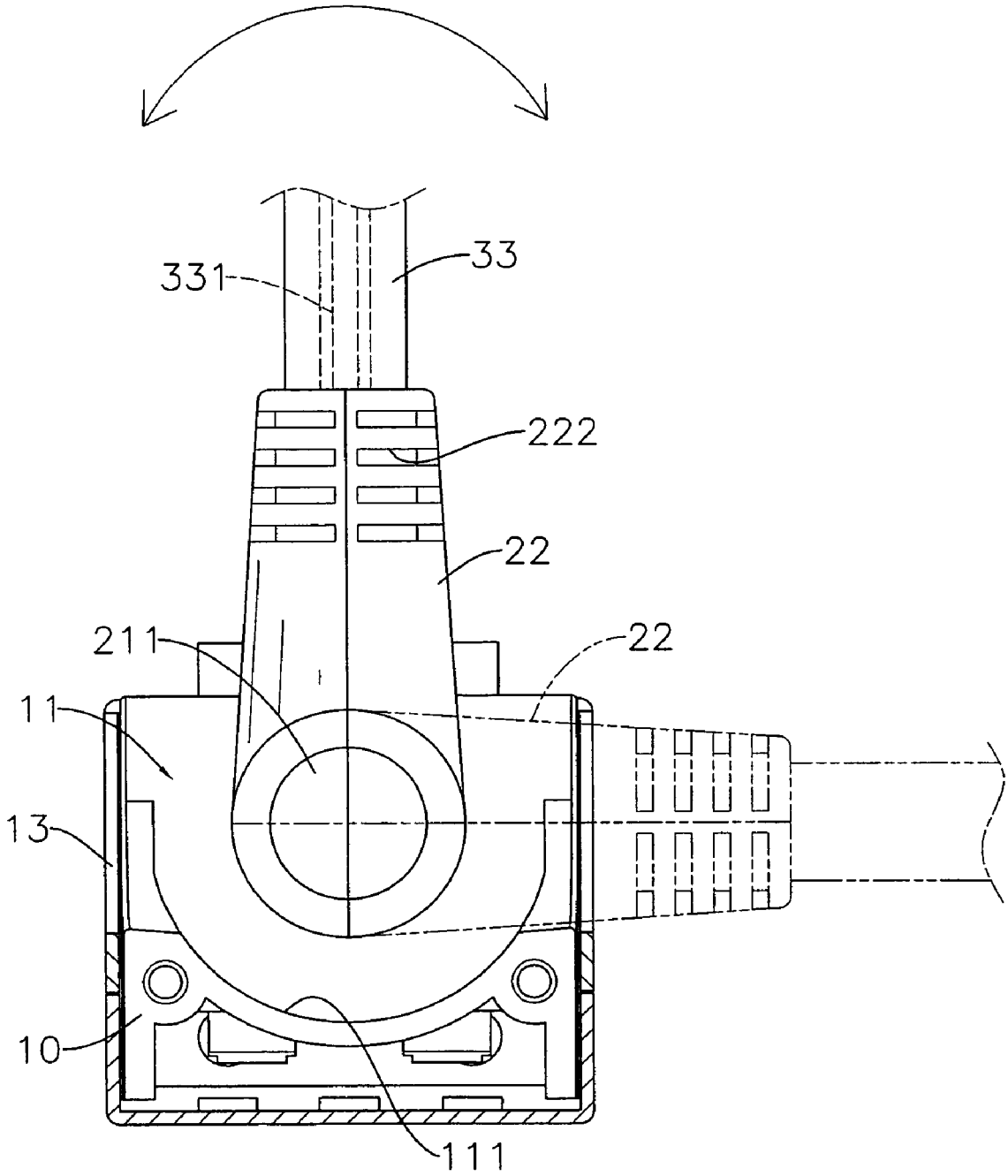
FIG. 5 is an enlarged operational side view in partial section of the wire guide in FIG. 3, showing the protecting tube being moved and a static position being shown in phantom lines.
Figure 6:
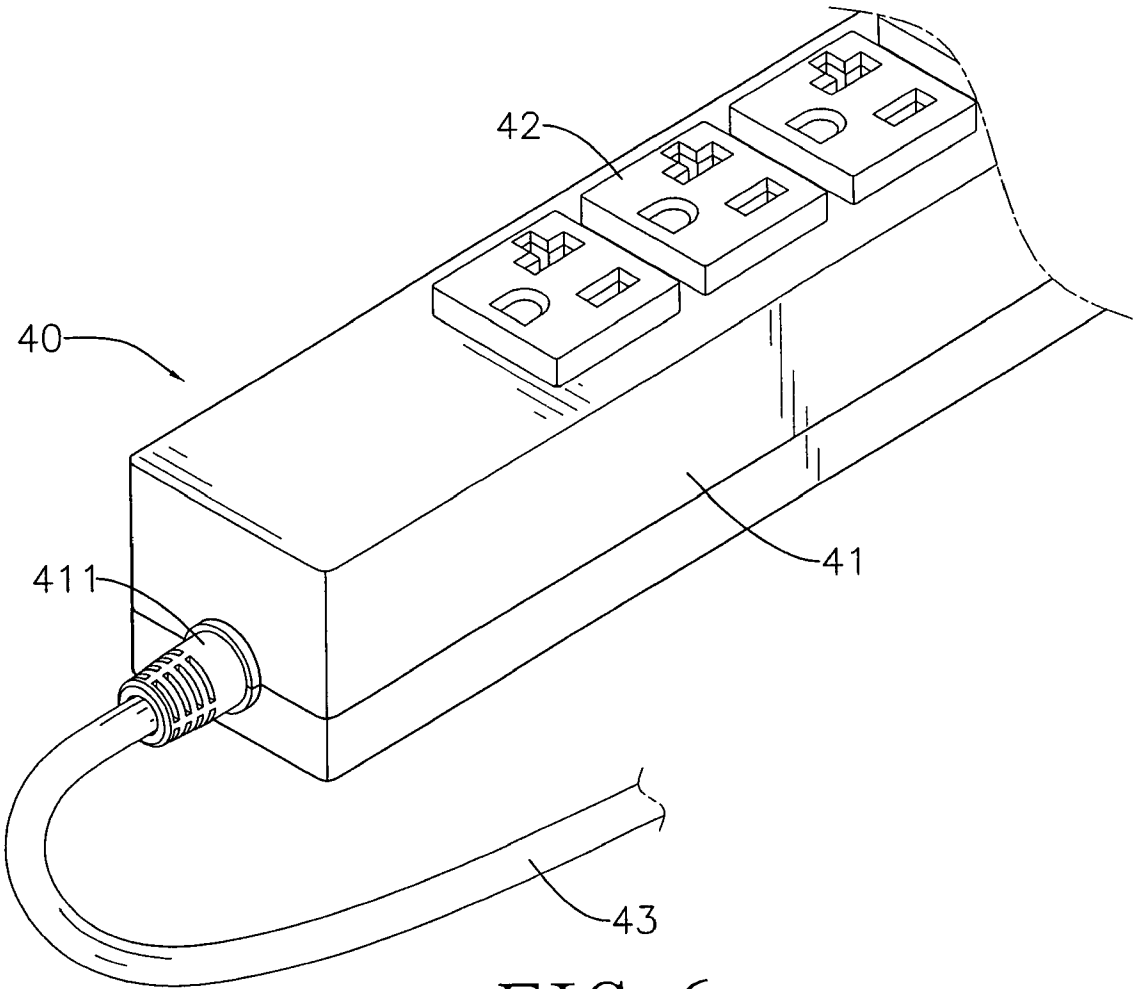
FIG. 6 PRIOR ART
FIG. 6 is a partial perspective view of a conventional electronic device in accordance with the prior art.

With further reference to FIG. 5, the shaft (21) is tubular and has a sidewall (213), two opposite ends (211) and a guiding channel (212). The ends (211) of the shaft (21) respectively protrude in the pivot holes (12) of the base (10) and are mounted rotatably on the opposite pivoting walls (14) of the base (10) to allow the protecting tube (20) to pivot relative to the base (10). The guiding channel (212) is formed through the shaft (21).

The cable mount (22) protrudes transversely from the sidewall (213) of the shaft (21), has a sidewall (223), a through hole (221) and may have multiple circumferential indentations (222). The through hole (221) is formed through the cable mount (22) and communicates with the guiding channel (212) of the shaft (21) to allow the wires (331) of the lead (33) of the electronic device (30) to be mounted through the guiding channel (212) of the shaft (21) and the through hole (221)

of the cable mount (22). The circumferential indentations (222) are formed around the sidewall (223) of the cable mount (22) to allow the cable mount (22) to be flexed more easily.

The wire guide (1) for the electronic device (30) as described has the following advantages. As the wires (331) of the lead (33) of the electronic device (30) are mounted through the protecting tube (20) of the wire guide (1), the lead (33) is smoothly pivoted toward different directions to be connected to the power supply and is limited by the limiting recesses (13) of the base (10) to prevent over-rotating. Therefore, The wires (331) of the lead (33) do not have to be bent repeatedly and wires of each wire (334) are not snapped easily. Furthermore, the electronic device (30) may be conveniently placed against a wall, in a corner or the like and the lead (33) moved for improved ease of installation and use.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A wire guide comprising a base having an upper surface;

two opposite pivoting walls;

a tube recess being formed in the upper surface of the base; and two pivot holes being respectively formed through the opposite pivoting walls of the base; and a protecting tube being disposed in the tube recess of the base, being mounted rotatably on the base, and having a shaft being tubular and having a sidewall;

two opposite ends respectively protruding in the pivot holes of the base and being mounted rotatably on the opposite pivoting walls of the base; and a guiding channel being formed through the shaft; and a cable mount protruding transversely from the sidewall of the shaft and having a through hole being formed through the cable mount communicating with the guiding channel of the shaft.

2. The wire guide as claimed in claim 1, wherein the tube recess of the base further has a bottom being semi-cylindrical; and the base further has two opposite limiting walls; and two limiting recesses being respectively formed in the limiting walls of the base and communicating with the tube recess.

3. The wire guide as claimed in claim 2, wherein each pivot hole of the base aligning with the other pivot hole of the base.

4. The wire guide as claimed in claim 3, wherein the protecting tube is resilient.

5. The wire guide as claimed in claim 4, wherein the cable mount of the protecting tube further has a sidewall; and multiple circumferential indentations being formed around the sidewall of the cable mount of the protecting tube.

* * * * *